United States Patent [19]

Menzi

[11] 4,113,081

[45] Sep. 12, 1978

[54] MECHANISM FOR ACTUATING A MEMBER OF A TYPEWRITER

[75] Inventor: Ulrich Menzi, Yverdon, Switzerland

[73] Assignee: Hermes Precisa International S.A., Yverdon, Switzerland

[21] Appl. No.: 696,864

[22] Filed: Jun. 16, 1976

[30] Foreign Application Priority Data

Jun. 24, 1975 [CH] Switzerland ..... 8170/75

[51] Int. Cl.[2] ..... B41J 19/54

[52] U.S. Cl. ..... 400/333; 400/370

[58] Field of Search ..... 197/82, 84 R, 84 A, 197/84 B, 97, 151, 157, 17

[56] References Cited

U.S. PATENT DOCUMENTS

| | | | |
|---|---|---|---|
| 1,950,762 | 3/1934 | Thompson | 197/157 |
| 2,043,393 | 6/1936 | Pasinski | 197/17 |
| 2,563,722 | 8/1951 | Hart | 197/82 X |
| 2,896,767 | 7/1959 | Barkdoll | 197/82 |
| 2,931,481 | 4/1960 | Salto | 197/17 |

*Primary Examiner*—Ernest T. Wright, Jr.

*Attorney, Agent, or Firm*—Emory L. Groff, Jr.

[57] ABSTRACT

A mechanism for actuating a universal bar of a typewriter from a continuously rotatable drive shaft comprises a principal lever cooperating with the universal bar and carrying a catch able to occupy an active position in the trajectory of a peripheral projection of the drive shaft and a rest position out of this trajectory. The principal lever additinally carries a locking lever cooperating with a control lever of the catch, the latter being connected to the control lever by a spring biasing them relative to one another into an angular position defined by abutments. A fixed stop is disposed in the path along which the control lever moves during an actuating movement of the principal lever in response to engagement of the catch by the projection. When the control lever abuts this stop, it returns to a position for locking the catch while the catch is still in engagement with said projection. Unlocking of the catch to move to its active position is provided by a slide rod having a shoulder for actuating the locking lever. The slide rod can have a second shoulder for permanently unlocking the catch to provide repeated operation of the universal bar.

4 Claims, 3 Drawing Figures

MECHANISM FOR ACTUATING A MEMBER OF A TYPEWRITER

The invention relates to mechanisms for actuating a member of a typewriter from a continuously rotating drive shaft, of the type comprising a principal lever cooperating with said member and carrying a catch able to occupy an active position in the trajectory of a peripheral projection of the shaft, and a rest position out of said trajectory.

An object of the invention is to provide a mechanism of the stated type of reliable operation and in which sliding and rubbing are substantially eliminated, and which is brought into a locked position before the end of its actuating movement.

To this end, the mechanism according to the invention is characterized in that the principal lever additionally carries a locking lever cooperating with a control lever of the catch, the latter being connected to the control lever by a spring biasing them relative to one another into an angular position defined by abutment means, and a fixed stop is disposed in the path of the control lever during movement of the principal lever in response to engagement of the catch by said projection to return the control lever to a position for locking the catch while the catch is still in engagement with said projection.

The accompanying drawing shows, schematically and by way of example, an embodiment of the mechanism according to the invention. In the drawing.

Figure 2:
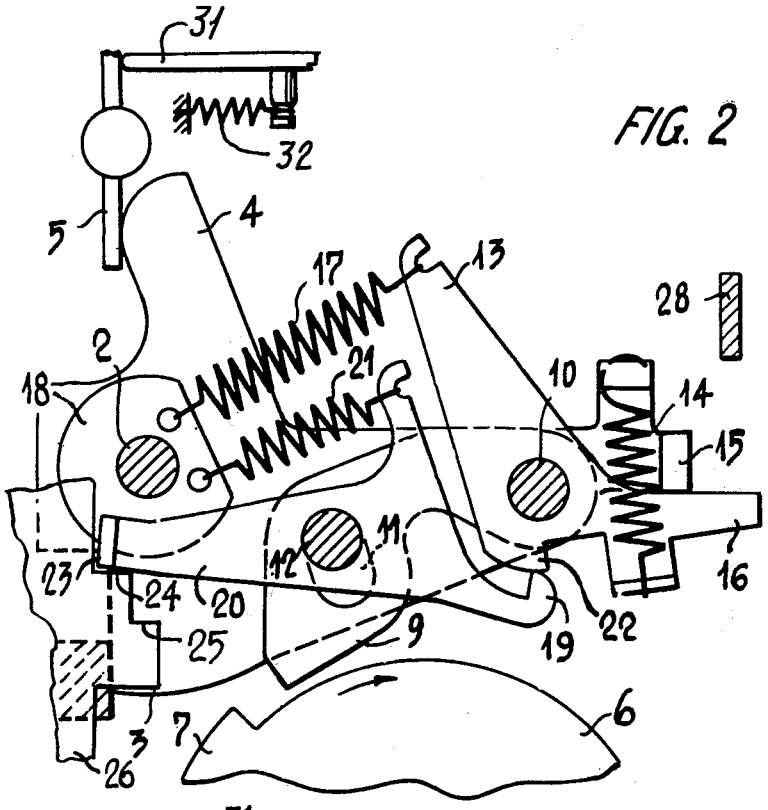
FIG. 2 is a partial elevational view of the mechanism in the active position.
Figure 3:
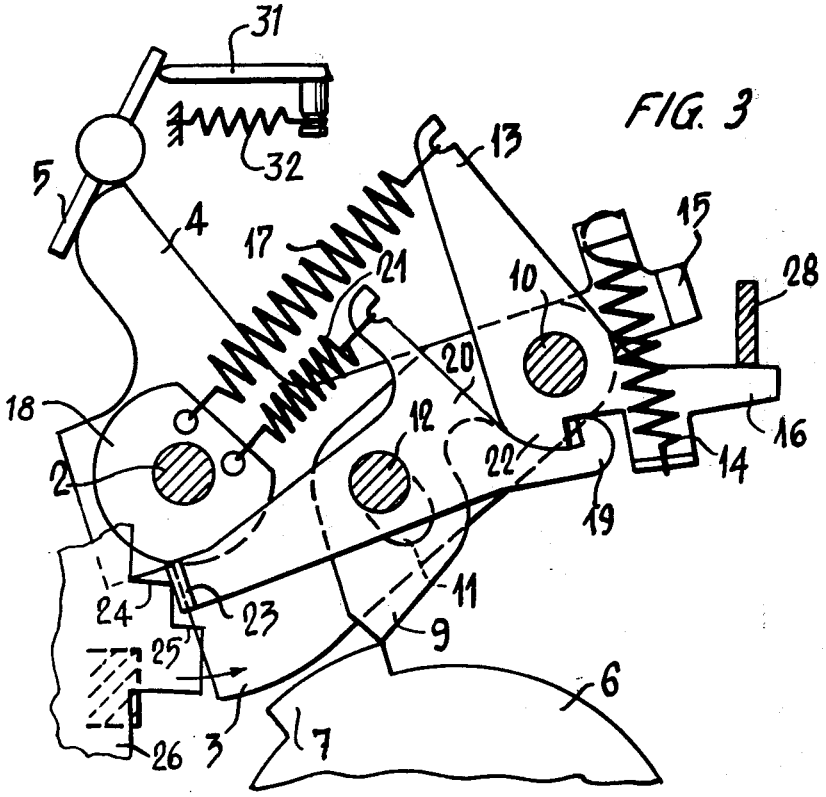
FIG. 3 is a view similar to FIG. 2 showing the various elements when the mechanism arrives at the end of the actuating path.

The mechanism shown comprises a support 1 which is fixed to the frame of a typewriter. This support 1 carries a pivot 2 on which a principal lever 3 is pivoted. Lever 3 has a beak 4 arranged to cooperate with a universal bar 5 of the typewriter, as shown in FIGS. 2 and 3, to drive the universal bar 5 from a continuously rotating drive shaft 6 having two projections 7, 8. When the universal bar 5 is driven by the drive shaft 6 and projections 7, 8, it actuates a movable member 31 against the action of a return spring 32.

Temporary actuation of the bar 5 from the rotary shaft 6 is provided by means of a catch 9 pivoted on a stud 10 carried by lever 3. The catch 9 has a slot 11 engaged on another stud 12 to limit the angular displacement of catch 9 in relation to lever 3.

The catch 9 can be placed in an active position, shown in FIG. 2, by means of a control lever 13 also pivoted on the stud 10. This control lever 13 is connected to the catch 9 by a spring 14 which tends to hold an abutment 15 of the catch 9 in contact with a beak 16 of control lever 13. The latter is also acted on by a spring 17 hooked to a piece 18 mounted on pivot 2.

Figure 1:
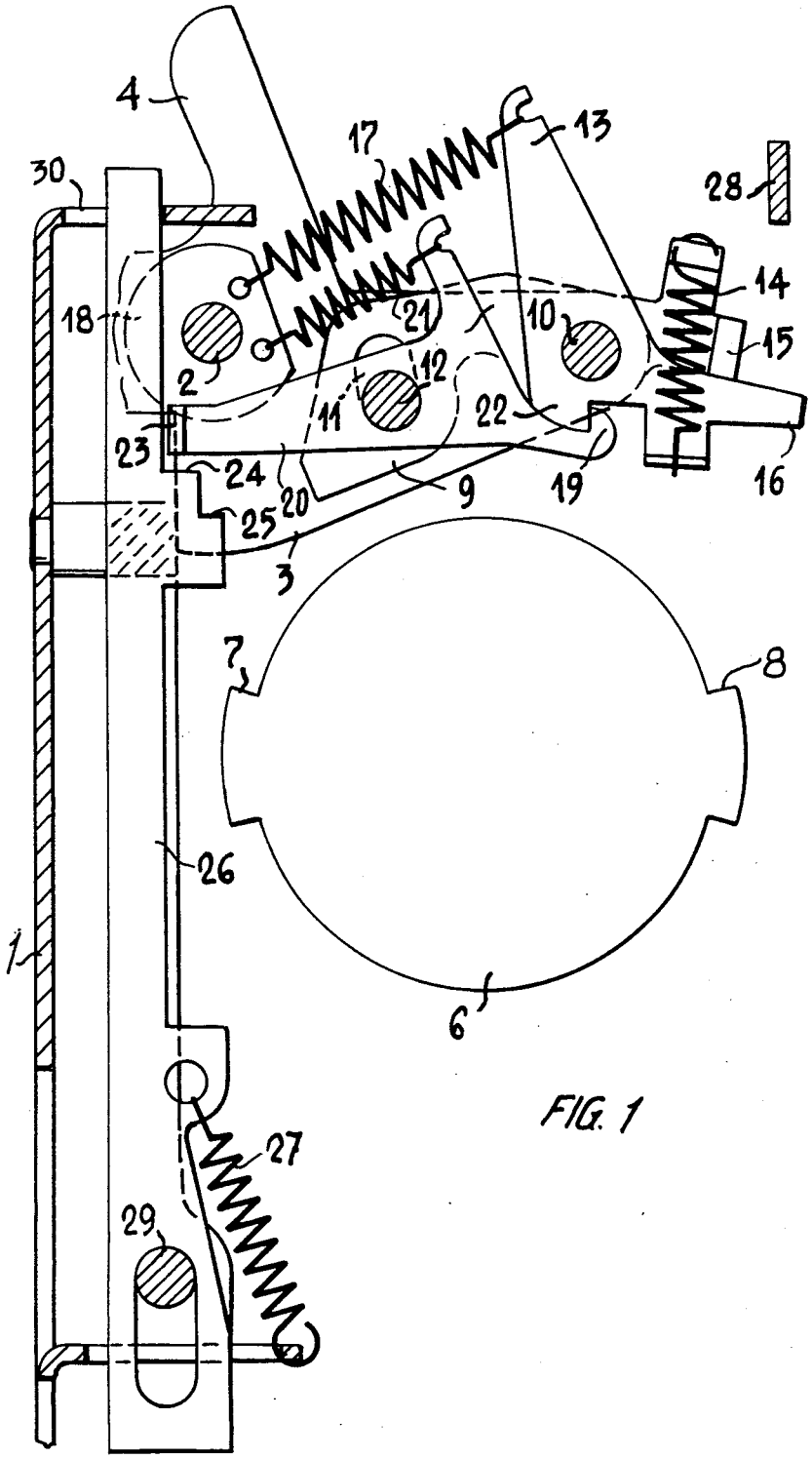
FIG. 1 is an elevational view of the mechanism in the rest position.

As illustrated in FIG. 1, the catch 9 and control lever 13 are held in position by a beak 19 of a lever 20 pivoted on the stud 12. This locking lever 20 is acted on by a spring 21 which holds the beak 19 in engagement with a corresponding beak 22 of the control lever 13.

At its end opposite the beak 19, lever 20 has a bent lug 23 arranged to be driven by a shoulder 24 or 25 of a slide rod 26 mounted on the support 1 and held down by a biasing spring 27 in the position illustrated in FIG. 1.

Operation of the mechanism is as follows :

To actuate the universal bar 5, which for example serves for the control of an escapement mechanism of the typewriter, the slide rod 26 is lifted up by a control member, not shown, against the action of spring 27.

The shoulder 24 of slide rod 26 acts on the bent lug 23 and pivots lever 20, against the action of spring 21, about stud 12 so that beak 19 frees beak 22. The control lever 13 thus pivots, with the catch 9, about stud 10 under the action of spring 17. This angular displacement is stopped by the stud 12 engaged in the slot 11 of the catch 9. The latter is thus in an active position in the trajectory of the projections 7, 8 of the rotating shaft 6.

When a projection 7 or 8 comes into contact with the catch 9, it drives catch 9 together with levers 3, 13 and 20, in a first phase, in a circular movement centered about the pivot 2. During this movement, the beak 4 of lever 3 actuates the universal bar 5.

In a second phase of pivoting of the lever 3, the control lever 13 is brought back to its initial locking position by cooperation of its beak 16 with a fixed stop 28.

During pivoting of the lever 3, the lug 23 of lever 20 slides on the shoulder 24 of slide rod 26 and falls to face the shoulder 25, which allows the spring 21 to return lever 20 into its position in which its beak 19 hookably engages the beak 22 of control lever 13.

FIG. 3 shows the mechanism in the position at the end of driving by the projection 7. As soon as the catch 9 escapes from projection 7, it is returned to the rest position by the spring 14 which returns it to its initial position relative to the control lever 13 which is locked by the beak 19 of lever 20.

Hence, the projections 7 and 8 of the shaft 6 can no longer actuate the universal bar 5 as long as the catch 9 is not unlocked and returned to the active position.

The described actuating mechanism can also operate to provide a repeated drive of the universal bar 5. For this purpose, the mechanism is actuated by a greater upwards displacement of the slide rod 26 so that at the end of pivoting of the lever 3, the lug 23 of lever 20, which has dropped from the shoulder 24, remains pushed up by the shoulder 25. In this manner, when the control lever 13 pivots by abutment with stop 28, the lever 20 is held so that its beak 19 cannot hook the beak 22 of lever 13.

The lever 3 reassumes its rest position under the action of a biasing force which may, for example, be exerted by the universal bar 5. During this return movement, the bent lug 23 does not mount on the shoulder 24, but comes to bear laterally against it. The return movement is possible because the lower part of the slide bar 26 can pivot on a rod 29 against the action of the spring 27, whereas its upper end can move laterally in a guide slot 30 of support 1.

I claim:

1. In a typewriter, a mechanism for actuating a member from a continuously rotatable drive shaft, comprising a principal lever cooperating with said member and carrying a catch able to occupy an active position in the trajectory of a peripheral projection of the shaft and a rest position out of said trajectory, a control lever for said catch, wherein the principal lever additionally carries a locking lever cooperating with said control lever of the catch, said catch being connected to the control lever by a spring biasing said catch and said control lever relative to one another into an angular position defined by abutment means, and a fixed stop is disposed in the path of the control lever during movement of the principal lever in response to engagement of the catch by said projection to return the control lever to a position for locking the catch while the catch is still in engagement with said projection.

2. A mechanism according to claim 1, comprising a member for unlocking the catch, said unlocking member cooperating with an end of the locking lever.

3. A mechanism according to claim 2, in which said member for unlocking the catch is a slide rod mounted in a support of the principal lever, the slide rod having at least one shoulder for actuating the locking lever.

4. A mechanism according to claim 3, in which the slide rod has two shoulders, one shoulder for moving the locking lever to a position for unlocking the catch for movement of said catch to an active position and the other shoulder for holding the locking lever in said unlocking position for the catch to remain in the active position as song as the slide rod is actuated.

* * * * *